US008621901B2

(12) United States Patent
Bacon

(10) Patent No.: US 8,621,901 B2
(45) Date of Patent: Jan. 7, 2014

(54) LOCK SYSTEM FOR VEHICLES AND THE LIKE

(75) Inventor: Bruce Bacon, Rockford, MI (US)

(73) Assignee: Bauer Products, Inc., Grand Rapids, MI (US)

( * ) Notice: Subject to any disclaimer, the term of this patent is extended or adjusted under 35 U.S.C. 154(b) by 113 days.

(21) Appl. No.: 13/186,885

(22) Filed: Jul. 20, 2011

(65) Prior Publication Data

US 2012/0186310 A1 Jul. 26, 2012

Related U.S. Application Data

(60) Provisional application No. 61/366,014, filed on Jul. 20, 2010.

(51) Int. Cl.

| | |
|---|---|
| ***E05B 27/00*** | (2006.01) |
| ***E05B 9/04*** | (2006.01) |
| ***E05B 15/14*** | (2006.01) |
| ***E05B 35/08*** | (2006.01) |
| ***E05B 35/10*** | (2006.01) |

(52) U.S. Cl.
USPC ..... 70/369; 70/371; 70/421; 70/337; 70/343; 70/360

(58) Field of Classification Search
USPC ..... 70/367–369, 371, 421, 337–343, 70/382–384, 360, 361
See application file for complete search history.

(56) References Cited

U.S. PATENT DOCUMENTS

| | | | |
|---|---|---|---|
| 145,835 | A | 12/1873 | Bissell |
| 374,391 | A | 12/1887 | Born |
| 745,042 | A | 11/1903 | Daves |
| 1,071,567 | A | 8/1913 | Outwater |
| 1,141,463 | A | 6/1915 | Hurd |
| 1,478,381 | A | 12/1923 | Crimmel |
| 1,593,011 | A | 7/1926 | Bourgon |
| 1,654,489 | A | 12/1927 | Teich |

(Continued)

FOREIGN PATENT DOCUMENTS

| | | |
|---|---|---|
| DE | 26 29 332 | 1/1978 |
| GB | 2 123 474 | 2/1984 |

OTHER PUBLICATIONS

TRI/MARK, "Travel Trailer Latch Dead Bolt Option—60-200 Series 60-250 Series," New Hampton, Iowa (date unknown, prior to Jun. 11, 2002).

(Continued)

*Primary Examiner* — Christopher Boswell
*Assistant Examiner* — Eric Kurilla
(74) *Attorney, Agent, or Firm* — Price Heneveld LLP

(57) ABSTRACT

A lock system is provided having a lock housing and a lock barrel, a keeper shoulder, at least one full positioner shoulder, and a positioner shoulder having a U-shaped channel. A lock plug having a keyway and tumblers is received in the barrel for rotation between locked and unlocked positions. The tumblers include a key tumbler, a positioner tumbler and a keeper tumbler. The lock plug is rotatable between a first rotary position and a second rotary position. A control key is received into the keyway to retract the lock tumbler and partially retract the keeper tumbler. Removal of the lock plug from the lock barrel requires rotation of the lock plug from the first rotary position to the second rotary position and the presence of the control key within the lock plug when in the second rotary position.

14 Claims, 5 Drawing Sheets

(56) References Cited

U.S. PATENT DOCUMENTS 1,678,498 A 7/1928 Crimmel
1,805,891 A 5/1931 Shinn
1,807,804 A 6/1931 Stone
1,845,732 A 2/1932 Tournier et al.
1,891,214 A * 12/1932 Falk ..... 70/368
1,945,779 A * 2/1934 Jacobi ..... 70/368
1,964,066 A 6/1934 Kaszmaul
2,022,718 A 12/1935 Heins
2,097,407 A 10/1937 Spinello
2,112,372 A 3/1938 Lofgren
2,201,957 A 5/1940 North
2,202,056 A 5/1940 Kandetzki
2,241,785 A 5/1941 Lofgren
2,253,547 A 8/1941 Adams
2,263,180 A 11/1941 Lofgren
2,322,948 A 6/1943 Lofgren
2,324,406 A 7/1943 Lofgren et al.
2,460,709 A 2/1949 Navarro
2,642,300 A 6/1953 Pelcin
2,668,076 A 2/1954 Troche et al.
2,735,706 A 2/1956 Pelcin
2,871,048 A 1/1959 Balogh
2,900,204 A 8/1959 Pelcin
2,987,908 A 6/1961 Pelcin
3,019,632 A 2/1962 Russell
3,027,188 A 3/1962 Eickstadt
3,080,743 A 3/1963 Stansberry
3,095,726 A 7/1963 Schlage
3,111,833 A 11/1963 Dettmer
3,190,093 A * 6/1965 Schlage ..... 70/383
3,206,958 A * 9/1965 Best ..... 70/373
3,234,765 A 2/1966 Kerr
3,283,549 A 11/1966 Mees
3,438,227 A 4/1969 Wolniak
3,514,979 A 6/1970 Wiesmann
D218,672 S 9/1970 Lauper
3,563,071 A 2/1971 Barger
3,580,016 A 5/1971 Kerr
3,668,907 A 6/1972 Pastva, Jr.
3,707,862 A 1/1973 Pastva, Jr.
D230,132 S 1/1974 Pastva, Jr.
3,782,141 A 1/1974 Doerrfeld
3,789,550 A 2/1974 Seiwert
3,998,080 A 12/1976 Fane
4,045,064 A 8/1977 Okada
4,052,092 A 10/1977 Bergen
4,075,879 A 2/1978 Christopher
4,138,869 A 2/1979 Pelcin
4,158,299 A 6/1979 Grabner et al.
4,272,975 A * 6/1981 Patriquin ..... 70/369
4,309,884 A 1/1982 Davis
4,312,197 A 1/1982 Carrion et al.
4,312,202 A 1/1982 Pastva, Jr. et al.
4,413,493 A 11/1983 Meinsen et al.
4,420,954 A 12/1983 Hieronymi et al.
4,438,964 A 3/1984 Peters
4,443,032 A 4/1984 Bonassi
4,474,393 A 10/1984 Kimura
4,508,379 A 4/1985 Mochida
D281,665 S 12/1985 Weinerman et al.
4,630,457 A 12/1986 Kincaid et al.
4,653,143 A 3/1987 Ketelhut et al.
4,677,834 A 7/1987 Hicks
4,689,976 A 9/1987 Larsen
4,715,201 A 12/1987 Craig
4,725,085 A 2/1988 Hu et al.
4,732,417 A 3/1988 Yang
4,761,978 A * 8/1988 Walla ..... 70/367
4,762,348 A 8/1988 Matsumoto
4,778,206 A 10/1988 Matsumoto et al.
4,821,539 A 4/1989 Steinbach
4,850,209 A 7/1989 Weinerman et al.
D303,617 S 9/1989 Russell et al.
D303,618 S 9/1989 Russell et al.
D303,621 S 9/1989 Russell et al.
D303,922 S 10/1989 Russell et al.
D304,155 S 10/1989 Russell et al.
4,892,338 A 1/1990 Weinerman et al.
4,912,953 A * 4/1990 Wobig ..... 70/383
4,914,932 A * 4/1990 Walla ..... 70/367
4,934,800 A 6/1990 Choi
4,936,122 A 6/1990 Osada
4,966,018 A 10/1990 Hauber
4,976,123 A 12/1990 Ceron et al.
D314,131 S 1/1991 Russell et al.
4,986,576 A 1/1991 Anderson
5,042,853 A 8/1991 Gleason et al.
5,058,937 A 10/1991 Miehe et al.
5,060,991 A 10/1991 Davidian et al.
5,074,009 A 12/1991 Simonton et al.
5,119,654 A 6/1992 Ceron et al.
5,127,686 A 7/1992 Gleason et al.
5,174,456 A 12/1992 Grody
5,180,201 A 1/1993 Hauber
5,182,929 A 2/1993 Myers
5,209,087 A * 5/1993 Cox ..... 70/369
D339,050 S 9/1993 Gleason et al.
5,265,453 A 11/1993 Konii
5,299,844 A 4/1994 Gleason
5,301,989 A 4/1994 Dallmann et al.
D346,731 S 5/1994 Larsen et al.
5,484,178 A 1/1996 Sandhu et al.
D369,084 S 4/1996 McConnell et al.
D371,500 S 7/1996 McConnell et al.
5,531,498 A 7/1996 Kowall
D373,298 S 9/1996 Miehe et al.
5,564,295 A 10/1996 Weinerman et al.
5,586,459 A 12/1996 Bullock et al.
5,586,795 A 12/1996 Sasaki
5,595,076 A 1/1997 Weinerman et al.
5,606,882 A 3/1997 Larsen et al.
5,611,227 A 3/1997 Solovieff
5,711,506 A 1/1998 Stillwagon
D390,086 S 2/1998 Weinerman et al.
D394,373 S 5/1998 Weinerman et al.
5,775,145 A * 7/1998 Kasper ..... 70/367
5,775,146 A 7/1998 Edwards et al.
5,799,520 A 9/1998 Laabs et al.
5,927,773 A 7/1999 Larsen et al.
5,964,110 A 10/1999 Crocco et al.
5,975,597 A 11/1999 Makiuchi et al.
6,042,159 A 3/2000 Spitzley
6,059,329 A 5/2000 Spitzley
6,076,386 A * 6/2000 Etchells et al. ..... 70/369
6,108,979 A 8/2000 Saffran et al.
6,138,883 A 10/2000 Jackson
6,203,086 B1 3/2001 Dirks
D440,481 S 4/2001 Bacon
6,220,649 B1 4/2001 Rife
6,257,030 B1 7/2001 Davis
6,309,008 B1 10/2001 Bacon
6,363,577 B1 4/2002 Spitzley
6,382,006 B1 5/2002 Field et al.
6,409,234 B1 6/2002 Larsen et al.
6,513,353 B1 2/2003 Weinerman et al.
6,604,393 B2 8/2003 Larsen et al.
6,651,467 B1 11/2003 Weinerman et al.
D485,155 S 1/2004 Bacon
6,685,240 B2 2/2004 Bacon
6,701,761 B1 3/2004 Chang et al.
6,708,537 B1 3/2004 Eschweiler et al.
6,758,503 B2 7/2004 Sadler
6,845,641 B2 1/2005 Hsieh
6,854,304 B2 2/2005 Linares
6,857,298 B2 2/2005 Linares
6,889,534 B2 * 5/2005 Koluch ..... 70/493
6,962,375 B2 11/2005 Linares
7,028,514 B2 4/2006 Banks
7,034,655 B2 4/2006 Magner et al.
7,070,216 B2 7/2006 von zur Muehlen
7,097,216 B2 8/2006 Lane
D529,367 S 10/2006 Zweibohnmer et al.
7,119,709 B2 10/2006 Magner et al.
7,168,755 B2 1/2007 Munezane

(56) References Cited

U.S. PATENT DOCUMENTS

| | | | | |
|---|---|---|---|---|
| 7,237,812 | B2 | 7/2007 | Tweedy | |
| 7,363,786 | B2 | 4/2008 | Terhaar et al. | |
| 7,401,484 | B1 | 7/2008 | Holmes et al. | |
| 7,520,152 | B2 | 4/2009 | Sabo et al. | |
| 7,918,115 | B2 * | 4/2011 | Fredriksson et al. | 70/367 |
| 8,186,191 | B2 * | 5/2012 | Bacon | 70/208 |
| 2004/0074269 | A1 | 4/2004 | Lee | |
| 2004/0237612 | A1 * | 12/2004 | Nugent | 70/382 |
| 2005/0011239 | A1 * | 1/2005 | Lurie et al. | 70/369 |
| 2006/0049647 | A1 | 3/2006 | von zur Muehlen | |
| 2006/0260203 | A1 | 11/2006 | Wong et al. | |
| 2007/0001479 | A1 | 1/2007 | Fukuda et al. | |
| 2007/0056338 | A1 | 3/2007 | Sabo et al. | |
| 2007/0163312 | A1 | 7/2007 | Shen | |
| 2008/0258867 | A1 | 10/2008 | Harris et al. | |
| 2010/0300162 | A1 | 12/2010 | Cappuccio et al. | |
| 2010/0321173 | A1 | 12/2010 | Magner et al. | |

OTHER PUBLICATIONS

TRI/MARK, "Tri/Mark Designers & Manufacturers of Vehicle Hardware Products," New Hampton, Iowa (1996).

* cited by examiner

LOCK SYSTEM FOR VEHICLES AND THE LIKE

CLAIM OF PRIORITY

Applicants hereby claim the priority benefits under the provisions of 35 U.S.C. §119(e), basing said claim of priority on related provisional U.S. Patent Application Ser. No. 61/366,014, filed Jul. 20, 2010.

BACKGROUND OF THE PRESENT INVENTION

Key locks for vehicles and the like are generally well known in the art. Recreational vehicles typically have a number of key locks to control access to various areas of the vehicle, such as access doors to the vehicle's interior, closures for storage compartments, and the like. Typically, such locks are configured to accept multiple keys to facilitate providing access at dealer lots, showrooms and the like. For example, salesmen will typically require access to all lockable areas of a vehicle to properly show the vehicle to a prospective buyer. Also, customers normally want to be shown numerous vehicles before making a final selection, such that the accurate management of the numerous vehicle keys involved presents a significant challenge. Special master keys are provided to access all areas of a number of different vehicles. Also, control keys are typically provided to remove an entire lock plug from a barrel of the lock housing.

Prior lock systems are generally effective; however, certain improvements would be advantageous. For example, in prior key lock systems, when the control key is inserted into a keyway of the lock plug, the lock plug can be easily removed by simply pulling the same directly outwardly along with the associated control key. More specifically, insertion of the control key retracts tumblers, including positioning and keeper tumblers, so that the lock plug is easily removed by a single outward pulling action. As a consequence, a common pick, such as a paper clip or the like, can be used to tamper with such key locks. Essentially, the pick is inserted into the keyway of the lock plug and adjusted, so as to retract the keeper tumblers, such that outward movement of the pick will release the lock plug from the lock housing barrel, and thereby permit access to the associated vehicle compartment. Consequently, a vehicle lock system having a more secure, tamper-resistant construction would be clearly advantageous.

Accordingly, an apparatus is desired having the aforementioned advantages and solving and/or making improvements on the aforementioned disadvantages.

SUMMARY OF THE PRESENT INVENTION

One aspect of the present invention is a lock system for vehicles and the like of the type having at least one entry closure. A lock housing is mounted adjacent the entry closure and includes a cylindrically-shaped lock barrel with at least one tumbler groove, a keeper shoulder disposed proximate an inner portion of the lock barrel, at least one full positioner shoulder, and a positioner shoulder having a channel, the tumbler groove being disposed between and separating the full positioner shoulder from the positioner shoulder having the channel. A cylindrically-shaped lock plug is closely received in the lock barrel for rotation between locked and unlocked positions and includes a keyway and a plurality of outwardly biased tumblers. The tumblers may include a key tumbler, a positioner tumbler disposed adjacent an outer portion of the lock plug, and a keeper tumbler disposed adjacent an inner portion of the lock plug. The lock plug is rotatable between a first rotary position and a second rotary position located a predetermined angle from the first rotary position. A control key is received into the keyway to retract the lock tumbler and the keeper tumbler. Included is a partial positioner shoulder having an inner end disposed proximate the inner portion of the lock plug, an outer end disposed proximate the outer portion of the lock plug and includes a cutout portion rotationally aligned with the positioner tumbler when assembled with a tip and a cutout face. Removal of the lock plug from the lock barrel requires rotation of the lock plug from the first rotary position to the second rotary position and the presence of the control key while in the second rotary position, thereby permitting axial shifting of the lock plug out of the lock barrel.

Another aspect of the present invention is a lock system for an entry closure. A lock housing is mounted adjacent the entry closure and includes a cylindrically-shaped lock barrel with at least one tumbler groove, a keeper shoulder disposed proximate an inner portion of the lock barrel, at least one full positioner shoulder, and a positioner shoulder having a substantially U-shaped channel. A cylindrically-shaped lock plug is closely received in the lock barrel for rotation between locked and unlocked positions, and includes an axially extending keyway and a plurality of radially shiftable outwardly biased tumblers. The tumblers may include a key tumbler, a positioner tumbler disposed adjacent to an outer portion of the lock plug, and a keeper tumbler disposed adjacent an inner portion of the lock plug. A control key is received into the keyway to retract the lock tumbler and the keeper tumbler. A master key is received into the keyway to fully retract both the lock tumbler and the positioner tumbler. A customer key is received into the keyway to fully retract both the positioner tumbler and the lock tumbler. A partial positioner shoulder includes and extends from an inner end disposed proximate the keeper shoulder to an outer end disposed proximate the outer portion of the lock plug, where the outer end includes a cutout portion.

A further aspect of the present invention is a lock system for vehicle entry closures. A lock housing is mounted adjacent the entry closure and includes a cylindrically-shaped lock barrel with a plurality of tumbler grooves, a keeper shoulder disposed proximate an inner portion of the lock barrel, at least one full positioner shoulder, and a positioner shoulder having a substantially U-shaped channel. A cylindrically-shaped lock plug is closely received in the lock barrel for rotation between locked and unlocked positions, and includes an axially extending keyway and a plurality of radially shiftable outwardly biased tumblers. The tumblers may include a key lock tumbler, a positioner tumbler disposed adjacent an outer portion of the lock plug, and a keeper tumbler disposed adjacent an inner portion of the lock plug. The lock plug has a first rotary position and a second rotary position. The keeper tumbler may be selectively axially aligned with the U-shaped channel in the second rotary position. A first key is closely received into the keyway to retract the lock tumbler and the keeper tumbler. A partial positioner shoulder includes and extends from an inner end proximate the keeper shoulder to an outer end including a cutout portion. Removal of the lock plug from the lock barrel requires insertion of the first key into the keyway in the first rotary position and rotation of the first key and the lock plug to the second rotary position, thereby permitting axial shifting of the lock plug out of the lock barrel.

These and other advantages of the invention will be further understood and appreciated by those skilled in the art by reference to the following written specification, claims and appended drawings.

DETAILED DESCRIPTION OF EMBODIMENTS

For purposes of description herein, the terms "upper," "lower," "right," "left," "rear," "front," "vertical," "horizontal" and derivatives thereof shall relate to the invention as oriented in the attached drawings. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
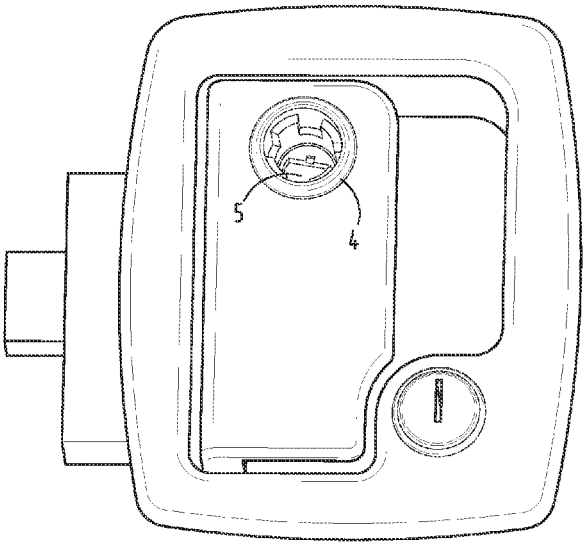
FIG. 3 PRIOR ART
FIG. 3 is a perspective view of the prior lock system, wherein the lock plug has been removed from the lock barrel.
Figure 4:
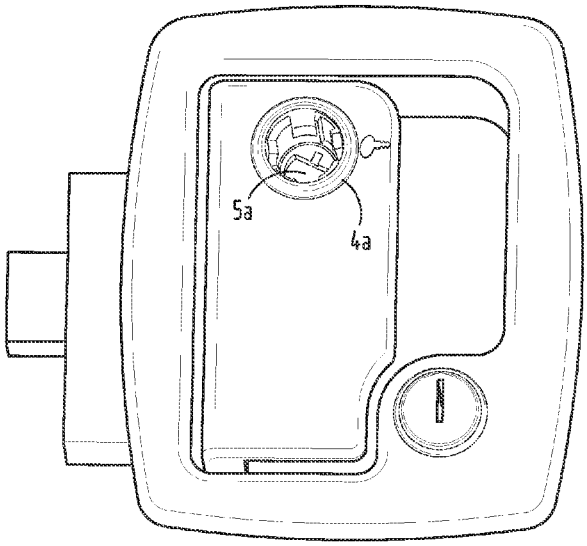
FIG. 4 is a perspective view of the improved lock system illustrating the first embodiment of the present invention, wherein the lock plug has been removed from the lock barrel.
Figure 5:
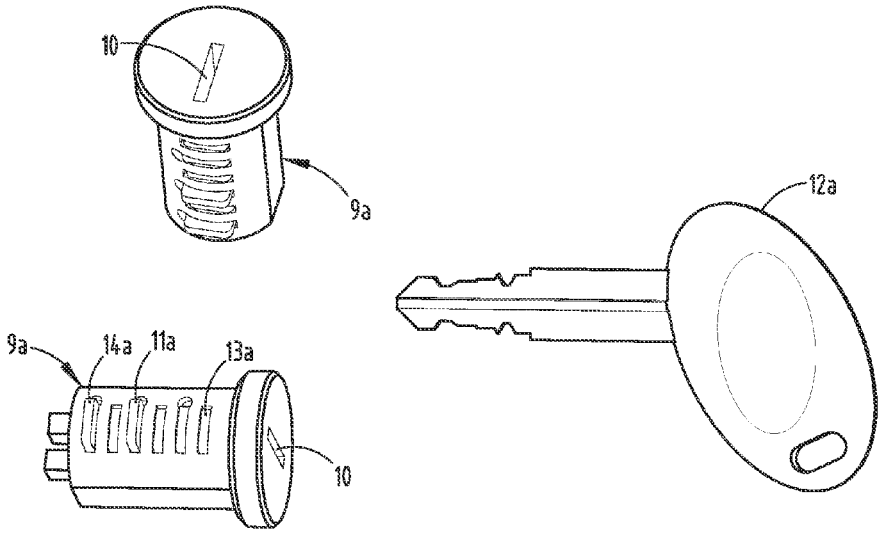
FIG. 5 contains perspective views of the first embodiment of the lock plug and a control key before insertion into the lock plug.
Figure 6:
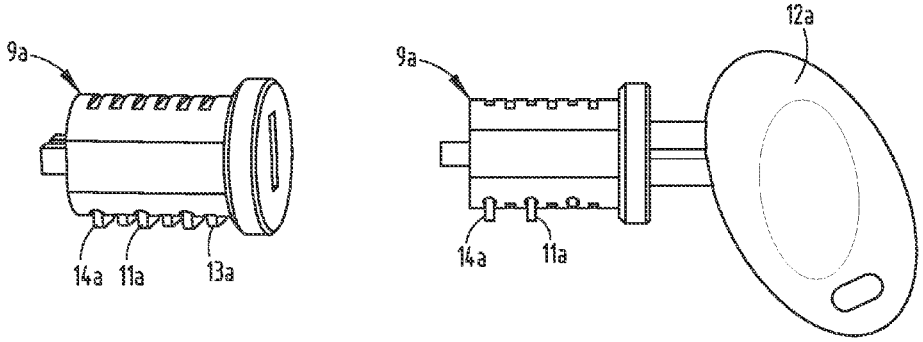
FIG. 6 contains perspective views of the lock plug and the control key after insertion into the lock plug.

The reference numeral 1 (FIGS. 1 and 3) illustrates a prior lock system that is disclosed in commonly owned U.S. Pat. No. 6,701,761, the disclosure of which is hereby incorporated by reference in its entirety, over which the present invention is an improvement. The prior lock system 1 includes a lock housing 4 disposed in the rotating paddle handle portion of the assembly, a lock barrel 5, and four tumbler grooves 6 with four solid positioner shoulders 7 disposed at right angles to one another. As disclosed in FIGS. 5 and 6, the lock plug 9*a* includes a plurality of spring loaded key or lock wafers or tumblers 11*a* which prevent the lock plug 9*a* from rotating in the lock barrel 5 unless an associated key is inserted therein. A positioner tumbler 13*a* is located axially outward of the key or lock tumblers 11*a* and also serves to prevent rotation of the lock plug 9*a* in the lock barrel 5 unless a specific key is inserted in a keyway 10 of the lock plug 9*a*. The lock plug 9*a* also includes an outer keeper tumbler 14*a*, which prevents the lock plug 9*a* from being removed axially from the lock barrel 5, unless a control key is inserted into the keyway 10.

Figure 1:
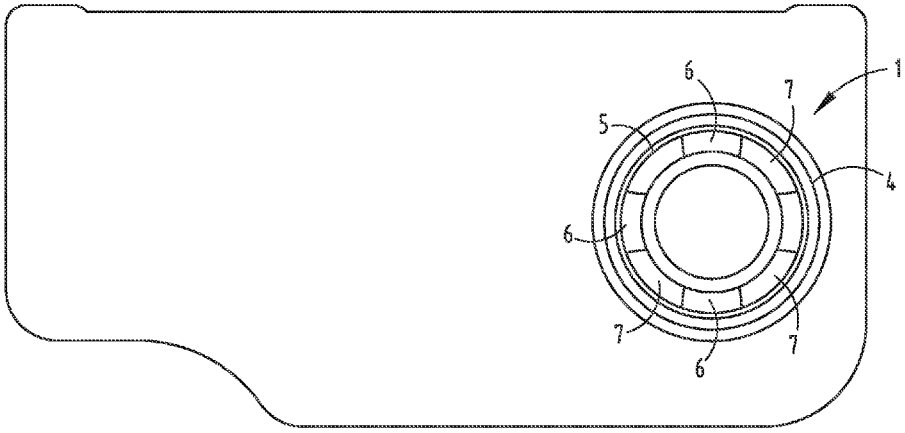
FIG. 1 PRIOR ART
FIG. 1 contains partially schematic plan views of a prior lock system for vehicles and the like, wherein a lock plug has been removed from a lock barrel.

As best illustrated in FIG. 1, when a control key 12*a* is inserted into the keyway 10 of the lock plug 9*a*, the entire lock plug 9*a* can be removed axially from the associated lock barrel 5 by simply pulling the key 12*a*, along with the lock plug 9*a* thereon, directly outwardly. A disadvantage of this construction, however, is the ease in which the lock plug 9*a* can be removed axially from lock barrel 5.

The reference numeral la generally designates a lock system embodying the present invention, and having a tamper-resistant construction with improved security and reliability overcomes the disadvantage of the prior art. Similar parts appearing in FIGS. 1 and 3, and the group of FIGS. 2 and 4-6, respectively, are represented by same, corresponding reference numerals. In the improved lock system la, lock housing 4*a* includes two of four generally trapezoidal positional shoulders 100 disposed between the four tumbler grooves 6*a* include an inwardly facing, U-shaped channel 101 which is configured to permit the exterior ends of the tumblers 11*a*, 13*a* and 14*a* to pass therethrough. The channels 101 are disposed diametrically opposite to one another, at an angle of approximately 45 degrees from the next adjacent tumbler grooves 6*a*. The lock plug 9*a* is configured such that it can be removed from the associated lock barrel 5*a* only when the lock plug 9*a* has been rotated 45 degrees with respect to the neutral position of the lock plug 9*a*, so that the tumblers 11*a*, 13*a* and 14*a* are aligned with the channels 101.

In accordance with the invention, a small portion on keeper tumbler 14*a* remains exposed, even after tumbler 14*a* is retracted. Thus, the lock plug 9*a* must be rotated 45 degrees in order to remove the lock plug 9*a*. In other words, even though the keeper tumbler 14*a* is retracted, it must line up with the channels 101 at the 45 degree angle for this exposed portion of the keeper tumbler 14*a* to be pulled axially from the lock barrel 5*a*. However, in order to remove this lock plug 9*a*, the tumblers 11*a* and 13*a* must first be retracted, and the lock plug 9*a* rotated and removed.

Figure 11:
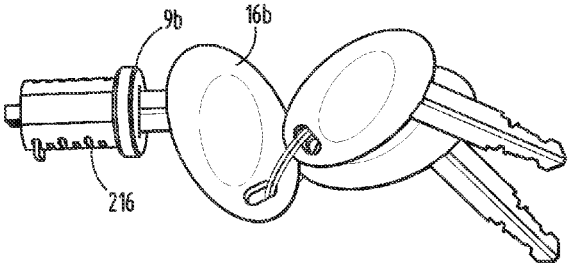
FIG. 11 is a perspective view of the lock plug of the second embodiment with a master key inserted into the lock plug.

In operation, when the control key 12*a* is inserted into the keyway 10 of the lock system la, the lock plug 9*a* still cannot be removed by simply pulling the control key 12*a* and associated lock plug 9*a* directly axially outwardly, as was taught by the prior art. Rather, the keeper tumbler 14*a* remains engaged in the lock barrel 5*a* to prevent direct outward axial motion of the lock plug 9*a* from the lock barrel 5*a*. Rather, a master key, similar to master key 16*b* shown in FIG. 11 and discussed below, inserted within the keyway 10 retracts tumblers 11*a* and allows the associated lock plug 9*a* to be rotated 45 degrees from the neutral position, so that keeper tumbler 14*a* is aligned in one of the two channels 101. Once so rotated, the master key is withdrawn and a control key 12*a* can be inserted in the lock plug 9*a* to retract keeper tumbler 14*a* so that the lock plug 9*a* can be pulled axially out of the associated lock barrel 5*a*.

Therefore, with all of the tumblers 11*a* and 13*a* retracted, the lock plug 9*a* can rotate to the position for removal. Moreover, with the new design of the keeper tumbler 14*a* disclosed herein, the keeper tumbler 14*a* can still be easily be retracted. However, it is difficult to simultaneously retract all of the tumblers 11*a*, 13*a* and 14*a*. Hence, even if a common pick is used to retract the keeper tumbler 14*a* of lock plug 9*a*, the lock plug 9*a* cannot be removed until the lock plug 9*a* is rotated 45 degrees, which is very difficult, if not impossible, when using a common pick. A highly specialized pick would be needed to retract all of the tumblers 11*a*, 13*a* and 14*a*, and then rotate the same 45 degrees to remove the lock plug 9*a*. Consequently, lock system la provides a tamper-resistant construction, which provides improved the overall lock security.

Figure 13:
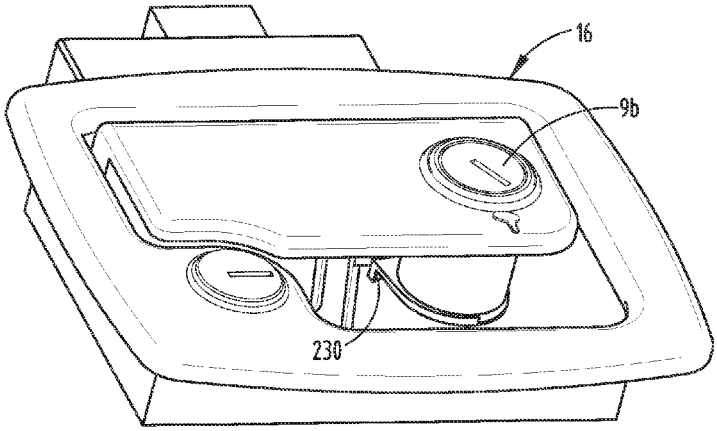
FIG. 13 is a perspective view of the second embodiment of the improved lock system, including a cam that is rotatable between locked and unlocked positions.

The reference numeral 1*b* generally designates another embodiment of a lock system embodying the present invention, and having a tamper-resistant construction with improved security. Similar parts appearing in FIGS. 1-6 and FIGS. 7-10, respectively, are represented by same, corresponding reference numerals, except for the suffix "b" in the numerals of the latter. The lock system 1*b* (FIG. 13) is configured to lock and unlock a paddle lock by having the lock plug 9*b* and the lock barrel 5*b* interact with a lock cam 230. Upon manipulation of the lock plug 9*b* by a key, the cam 230 is rotated between locked and unlocked positions, thereby preventing and allowing paddle rotation, respectively.

Figure 7:
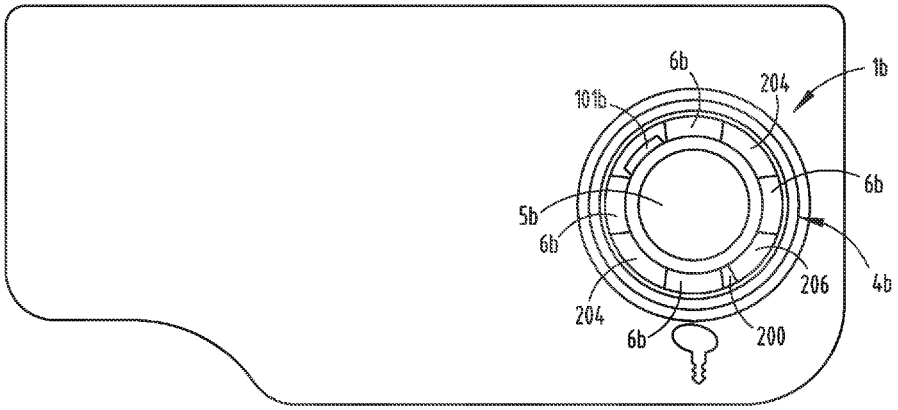
FIG. 7 contains partially schematic plan views of a second embodiment of an improved lock system for vehicles and the like, wherein the lock plug has been removed from the lock barrel.
Figure 8:
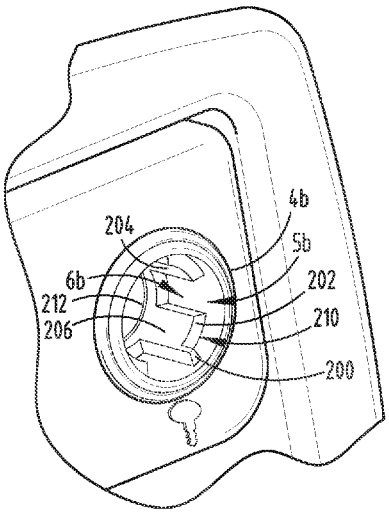
FIG. 8 is a perspective view of the second embodiment of the improved lock system for vehicles and the like, wherein the lock plug has been removed from the lock barrel.
Figure 9:
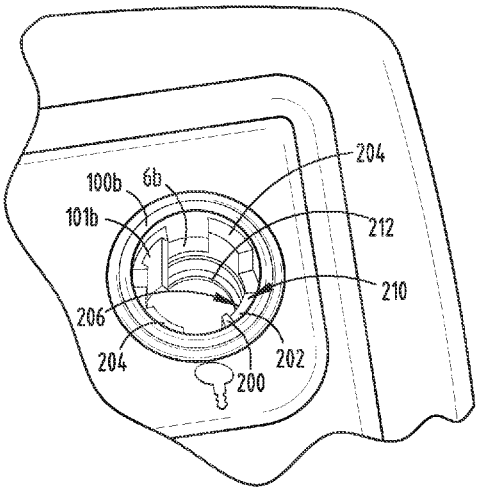
FIG. 9 is a perspective view of the lock barrel of the second embodiment.

Referring to FIGS. 7-9, in the improved lock system 1*b*, a keeper shoulder 212 extends circumferentially around the lock barrel 5*b* at a location proximate the inner end of the lock barrel 5*b*. The lock barrel 5*b* also includes one generally trapezoidal positional shoulder 100*b* disposed between two of the four tumbler grooves 6*b* and includes an inwardly facing, U-shaped channel 101*b* which is configured to permit the exterior ends of the tumblers 11*b*, 13*b* and 14*b* to pass therethrough. The channel 101*b* is disposed diametrically opposite to a partial positioner shoulder 206, with both the partial positioner shoulder 206 and the U-shaped channel 101*b* at an angle of approximately 45 degrees from the next adjacent respective tumbler grooves 6*b*. Both the channel 101*b* and the partial positioner shoulder 206 are at an angle of approximately 90 degrees from adjacent full positioner shoulders 204. The full positioner shoulders 204 are similarly of a generally trapezoidal geometry, but do not contain a U-shaped channel or indentation of any type.

The partial positioner shoulder 206 is also of a generally trapezoidal geometry, such that it does not contain a channel or indentation. The partial positioner shoulder 206 is distinct from the previously described shoulders, 100*b*, 204, based on a cutout portion 210 that includes a void in the trapezoidal shape at an outer end of the partial positioner shoulder 206. The cutout portion 210 is defined by a tip 200 that extends axially outward to a position in the lock barrel 5*b* that is proximate that of the outer end of the full positioner shoulders 204 and positioner shoulder 100*b*. The outer end of the partial positioner shoulder 206 is therefore defined by the tip 200, which juts axially inward, with respect to the lock barrel 5*b*, and radially away from the tip 200, with the portion axially inward of the tip 200 defining a cutout face 202. The cutout portion 210 is axially aligned to allow the positioner tumbler 13*b* to rotate within the lock barrel 5*b* between an adjacent full positioner shoulder 204 and the tip 200 of the cutout portion 210.

Figure 10:
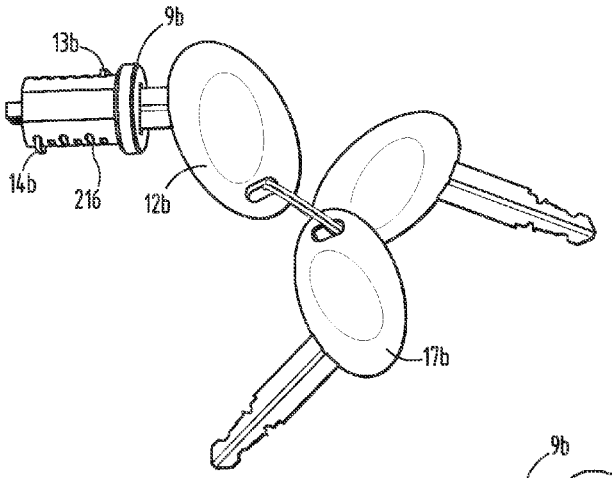
FIG. 10 is a perspective view of the lock plug of the second embodiment with a control key inserted into the lock plug.

Referring to FIG. 10, the associated lock plug 9*b* is similar to the previously described lock plug 9, and is configured to include a plurality of slots 216 that house the tumblers 11*b*, 13*b* and 14*b*. The lock plug 9*b* is also similarly configured, such that it can be removed from the associated lock barrel 5*b* only when the lock plug 9*b* has been rotated 45 degrees from a first rotary position with respect to the neutral position of the lock plug 9*b*, to a second rotary position, such that the tumblers 13*b* and 14*b* are aligned with the channel 101*b*. The first embodiment of the present invention described above and illustrated in FIGS. 2 and 4-6, although requiring rotation of the lock plug 9*b*, does not permit the control key 12*b* to rotate the lock plug 9*b*. Rather, an additional key, such as a master key 16*b* is required to rotate the lock plug 9*b* into a specified position prior to insertion of the control key 12*b* that facilitates axial removal of the lock plug 9*b*. In contrast, the cutout portion 210 of the second embodiment allows rotation of the lock plug 9*b* by the control key 12*b*. Insertion of the control key 12*b* into the keyway retracts the lock tumblers 11*b* completely, but only causes the positioner tumbler 13*b* and keeper tumbler 14*b* to be retracted, sufficient to retain the keeper tumbler 14*b* within the keeper shoulder 212, except proximate the channel 101*b* as discussed below. The positioner tumbler 13*b* extends 180 degrees from the keeper tumbler 14*b*. The portion of the positioner tumbler 13*b* that protrudes outward is located proximate the cutout portion 210 of the lock plug 9*b*. Therefore, in the lock housing 5*a*, cutout portion 210 allows the positioner tumbler 13*a* and lock plug 9*b* to be rotated 45 degrees when the control key 12*b* is installed. Once it has rotated 45 degrees, the keeper tumbler 14*b* is aligned with U-shaped channel 101*b* and the lock cylinder 9*b* can be removed. Advantageously, contact of the positioned tumbler 13*a* with the partial positioner shoulder 206 provides a positive stop and feedback to the user that the lock plug 9*b* may be withdrawn from the lock barrel 5*b*.

As noted above, the U-shaped channel 101*b* extends down to the keeper shoulder or groove 212 that receives the keeper tumbler 14*b*. Similarly, the lock cylinder 9*a* can be installed into the lock housing 5*b* with the control key 12*b* when the keeper tumbler 14*b* is aligned with the U-shaped channel 101*b*. The lock cylinder 9*a* is inserted, rotated counterclockwise and the control key 12*b* is removed. The keeper tumbler 14*b* is then fully extended into the keeper shoulder or retaining groove 212 once the control key 14*b* is removed. It should be noted that because the positioned tumbler 13*b* is not completely retracted, the control key 12*b* can only function when the lock cylinder 9*b* is in the unlocked position.

Further, when the control key 12*b* is installed in the lock cylinder 9*b*, which is possible only in the unlocked position of the lock cylinder 9*b*, the extended portion of the keeper tumbler 14*b* also aids in the installation and removal of the lock cylinder 9*b*. The installation is aided because the extended portion of the keeper tumbler 14*b* slides readily along the guide created by the U-shaped channel 101*b*. The extended portion of the keeper tumbler 14*b* also retains the lock cylinder 9*b* in the housing 5*b* while it is rotated within the lock barrel 5*b* Essentially, it makes it easier for the installer because the lock cylinder 9*b* is held in the axial direction. Removal is aided because the retained lock cylinder 9*b* can be rotated until the keeper tumbler 14*b* is aligned with the U-shaped channel 101*b*. Thus, the present invention makes it easy to install/remove the lock cylinder 9*b*, while at the same time making certain that the lock cylinder 9*b* is retained in the lock barrel 5*b*.

The master key 16*b* retracts all the tumblers except the keeper tumbler 14*b*. Therefore, as in the usual case, the master key 16*b* allows the lock cylinder 9*b* to be rotated between the locked and unlocked position. The master key 16*b* will always function in the lock cylinder 9*b* for the purpose of locking and unlocking.

Figure 12:
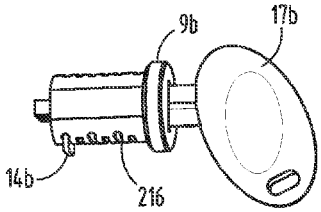
FIG. 12 is a perspective view of the lock plug of the second embodiment with a customer key inserted into the lock plug.

In addition to the control key 12*b* and master key 16*b*, the lock system 1*b* includes a customer key 17*b*. The construction of each key is described in detail in U.S. Pat. No. 6,701,761, which, as stated previously, has been incorporated in its entirety to this specification. The master key 16*b* (FIG. 11) is inserted into the keyway 10*b* of the lock plug 9*b* to retract the lock tumblers 11*b* and the positioner tumbler 13*b*. The customer key 17*b* (FIG. 12) is inserted into the keyway 10*b* of the lock plug 9*b* to similarly retract the lock tumblers 11*b* and the positioner tumbler 13*b*, but leaves the keeper tumbler 14*b* fully engaged with the keeper shoulder 212.

Figure 2:
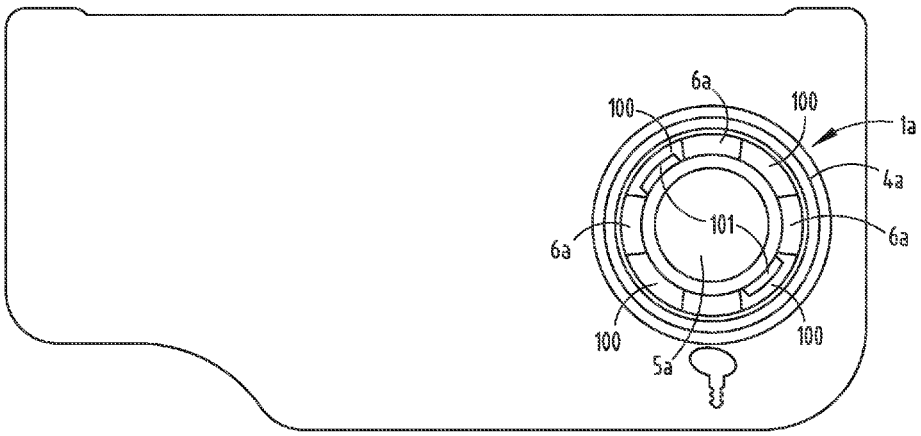
FIG. 2 contains partially schematic plan views of a first embodiment of an improved lock system for vehicles and the like, wherein the lock plug has been removed from the lock barrel.

In operation, when a control key 12*b* is inserted into the keyway 10*b* of the lock system 1*b*, the lock tumbler 11*b* is retracted, as shown in FIG. 10. The positional tumbler is unchanged, With the keeper tumbler 14*b* still engaged with the keeper shoulder 212, the lock plug 9*b* cannot be removed by simply pulling the control key 12*b* and associated lock plug 9*b* directly axially outwardly. The keeper tumbler 14*b* will remain engaged in the lock barrel 5*b* to prevent direct outward axial motion of the lock plug 9*b* from the lock barrel 5*b*. Rather, the control key 12*b* and associated lock plug 9*b* must be rotated 45 degrees clockwise from the neutral position, as shown in FIG. 2, so that the keeper tumbler 4*b* comes into alignment with the channel 101*b* and is no longer restrained by the keeper shoulder 212. Once the lock plug 9*b* is so rotated, the lock plug 9*b* can be pulled or shifted axially out of the associated lock barrel 5*b*. Hence, even if a common pick is used to retract the keeper tumbler 14*b* of lock plug 9*b*, the lock plug 9*b* cannot be removed until the lock plug 9*b* is rotated 45 degrees, which is very difficult, if not impossible, when using a common pick. A highly specialized pick would need to be constructed to retract all of the tumblers 11*b*, 13*b* and 14*b*, and then rotate the same 45 degrees to remove the lock plug 9*b*. Consequently, lock system 1*b* has a tamper-resistant construction, which provides improved the overall lock security, while also allowing a single key, the control key 12*b*, to rotate and remove the lock plug 9*b*.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. In a lock system for vehicles and the like of the type having at least one entry closure, comprising:

a lock housing for mounting adjacent the entry closure and including a cylindrically-shaped lock barrel with at least one tumbler groove extending axially therealong, a keeper shoulder disposed proximate an inner portion of the lock barrel, at least one full positioner shoulder, and a positioner shoulder having a channel, the tumbler groove being disposed between and separating the full positioner shoulder from the positioner shoulder having the channel;

a cylindrically-shaped lock plug shaped for close reception in the lock barrel for rotation between locked and unlocked positions, and including an axially extending keyway and a plurality of radially shiftable outwardly biased tumblers comprising at least one key actuated lock tumbler, a positioner tumbler disposed adjacent an outer portion of the lock plug, and a keeper tumbler disposed adjacent to an inner portion of the lock plug for engagement with the keeper shoulder, wherein the lock plug includes a first rotary position and a second rotary position located a predetermined angle from the first rotary position, the keeper tumbler being axially aligned with the channel within the lock plug in the second rotary position;

a control key having a shank portion shaped for close reception in the keyway with a plurality of bits configured to retract the lock tumbler and the keeper tumbler;

a master key having a shank portion shaped for close reception in said keyway with a plurality of bits configured to retract only the lock tumbler and the positioner tumbler; and a customer key having a shank portion shaped for close reception in the keyway with a plurality of bits configured to retract only the positioner tumbler and the lock tumbler;

wherein the lock barrel further comprises a partial positioner shoulder having an inner end disposed proximate the inner portion of the lock plug, an outer end disposed proximate the outer portion of the lock plug and a cutout portion rotationally aligned with the positioner tumbler when assembled with a tip and a cutout face;

whereby removal of the lock plug from the lock barrel requires rotation of the lock plug from the first rotary position to the second rotary position and the presence of the control key within the keyway and wherein rotation of the lock plug from the first rotary position to the second rotary position is obtained by insertion of the control key within the keyway and rotation of the lock plug from the first rotary position to the second rotary position, wherein the positioner tumbler is rotated into the cutout portion, thereby permitting axial shifting of the lock plug out of the lock barrel for repair or replacement.

2. The lock system of claim 1, wherein the tip extends to the outer end of the partial positioner shoulder, and wherein the tip is axially outward of the cutout face of the cutout portion.

3. The lock system of claim 1, wherein the cutout portion is configured to allow the positioner tumbler to rotate within the cutout portion between the tip of the partial positioner shoulder and an adjacent full positioner shoulder.

4. The lock system of claim 1, wherein said lock barrel includes a plurality of tumbler grooves extending axially therealong.

5. The lock system of claim 1, wherein the predetermined angle is 45 degrees.

6. The lock system of claim 1, wherein the keeper tumbler engages the keeper shoulder in the first rotary position and wherein the keeper tumbler is rotationally aligned with the channel in the second rotary position.

7. The lock system of claim 1, wherein the lock plug is configured so that it cannot be removed from the lock housing by the master key.

8. The lock system of claim 1, wherein the lock housing includes a cam which rotates between locked and unlocked positions to selectively retain the entry closure in a locked position.

9. The lock system of claim 1, wherein the tumblers comprise spring biased wafer tumblers, and wherein the lock plug includes a plurality of lock tumblers.

10. A lock system for an entry closure, comprising:

a lock housing for mounting adjacent the entry closure and including a cylindrically-shaped lock barrel with at least one tumbler groove extending axially therealong, a keeper shoulder disposed proximate an inner portion of said lock barrel, at least one full positioner shoulder, and a positioner shoulder having a substantially U-shaped channel;

a cylindrically-shaped lock plug shaped for close reception in the lock barrel for rotation between locked and unlocked positions, and including an axially extending keyway and a plurality of radially shiftable outwardly biased tumblers comprising at least one key actuated lock tumbler, a positioner tumbler disposed adjacent to an outer portion of the lock plug, and a keeper tumbler disposed adjacent to an inner portion of the lock plug;

a control key having a shank portion shaped for close reception in the keyway with a plurality of bits configured to retract the lock tumbler and the keeper tumbler when inserted into the keyway;

a master key having a shank portion shaped for close reception in the keyway with a plurality of bits configured to fully retract both the lock tumbler and the positioner tumbler, and not retract the keeper tumbler when inserted into the keyway;

a customer key having a shank portion shaped for close reception in said keyway with a plurality of bits configured to fully retract both the positioner tumbler and the lock tumbler, and not retract the keeper tumbler when inserted into the keyway; and a partial positioner shoulder including and extending from an inner end disposed proximate the keeper shoulder to an outer end disposed proximate the outer portion of the lock plug, wherein the outer end includes a cutout portion;

whereby removal of the lock plug from the lock barrel requires rotation of the lock plug from the first rotary position to the second rotary position wherein the keeper tumbler is axially aligned with the U-shaped channel and the presence of the control key within the keyway and wherein rotation of the lock plug from the first rotary position to the second rotary position is obtained by insertion of the control key within the keyway and rotation of the lock plug from the first rotary position to the second rotary position, wherein the positioner tumbler is rotated into the cutout portion, thereby permitting axial shifting of the lock plug out of the lock barrel for repair or replacement.

11. The lock system of claim 10, wherein the partial positioner shoulder includes a tip that extends to the outer end of the partial positioner shoulder, wherein the tip is axially outward of a cutout face of the cutout portion.

12. The lock system of claim 10, wherein the cutout portion is configured to allow the positioner tumbler to rotate within the cutout portion between the tip of the partial positioner shoulder and an adjacent full positioner shoulder.

13. The lock system of claim 10, wherein the keeper tumbler is positioned for abutting contact with the keeper shoulder in the first rotary position and wherein the keeper tumbler is rotationally aligned with the U-shaped channel in the second rotary position.

14. A lock system for vehicle entry closures, comprising:

a lock housing for mounting adjacent the entry closure and including a cylindrically-shaped lock barrel with a plurality of tumbler grooves extending axially therealong, a keeper shoulder disposed proximate an inner portion of the lock barrel, at least one full positioner shoulder and a positioner shoulder having a substantially U-shaped channel, the tumbler groove being disposed between and separating the full positioner shoulder from the positioner shoulder having the U-shaped channel;

a cylindrically-shaped lock plug shaped for close reception in the lock barrel for rotation between locked and unlocked positions, and including an axially extending keyway and a plurality of radially shiftable outwardly biased tumblers comprising at least one key actuated lock tumbler, a positioner tumbler disposed adjacent to an outer portion of said lock plug, and a keeper tumbler disposed adjacent to an inner portion of said lock plug, the lock plug having a first rotary position in the lock barrel wherein the keeper tumbler is positioned for abutting contact with the keeper shoulder and a second rotary position wherein the keeper tumbler is axially aligned with the U-shaped channel; and a control key having a shank portion shaped for close reception in the keyway with a plurality of bits configured to retract the lock tumbler and the keeper tumbler;

a master key having a shank portion shaped for close reception in said keyway with a plurality of bits configured to retract only the lock tumbler and the positioner tumbler; and a customer key having a shank portion shaped for close reception in the keyway with a plurality of bits configured to retract only the positioner tumbler and the lock tumbler;

the lock barrel further comprising a partial positioner shoulder including and extending from an inner end located proximate the keeper shoulder to an outer end including a cutout portion, the partial positioner shoulder further including a tip that extends to the outer end of the partial positioner shoulder, wherein the tip is axially outward of a cutout face of the cutout portion, and wherein the cutout portion is configured to allow the positioner tumbler to rotate within the cutout portion between the tip of the partial positioner shoulder and an adjacent full positioner shoulder when the control key is inserted within the keyway;

whereby removal of the lock plug from the lock barrel requires rotation of the lock plug from the first rotary position to the second rotary position wherein the keeper tumbler is axially aligned with the U-shaped channel and the presence of the control key within the keyway and wherein rotation of the lock plug from the first rotary position to the second rotary position is obtained by insertion of the control key within the keyway and rotation of the lock plug from the first rotary position to the second rotary position, wherein the positioner tumbler is rotated into the cutout portion, thereby permitting axial shifting of the lock plug out of the lock barrel for repair or replacement.

* * * * *

UNITED STATES PATENT AND TRADEMARK OFFICE

CERTIFICATE OF CORRECTION

PATENT NO. : 8,621,901 B2
APPLICATION NO. : 13/186885
DATED : January 7, 2014
INVENTOR(S) : Bruce C. Bacon It is certified that error appears in the above-identified patent and that said Letters Patent is hereby corrected as shown below:

In the Specification

Col. 1, line 6
"Applicants hereby claim" should be — Applicant hereby claims —
Col. 4, lines 16 and 22
"la" should be — 1a —
Col. 4, line 25
"include" should be — including —
Col. 4, line 46
"la" should be — 1a —
Col. 4, line 64
Delete "be" (first occurrence)
Col. 5, line 6
"la" should be — 1a —
Col. 5, line 7
Delete "the"
Col. 6, lines 20 and 33
"positioned" should be — positioner —
Col. 6, line 45
"5b" should be — 5b. —
Col. 7, lines 5 and 6
"positional tumbler is unchanged, With" should be — positioner tumbler is unchanged, with —
Col. 7, line 26
Delete "the" (first occurrence)

Signed and Sealed this
Sixth Day of January, 2015

Michelle K. Lee

Michelle K. Lee
*Deputy Director of the United States Patent and Trademark Office*